US008904800B2

(12) United States Patent
Patel et al.

(10) Patent No.: US 8,904,800 B2
(45) Date of Patent: Dec. 9, 2014

(54) COMBUSTOR HEAT SHIELD WITH INTEGRATED LOUVER AND METHOD OF MANUFACTURING THE SAME

(71) Applicant: Pratt & Whitney Canada Corp., Longueuil (CA)

(72) Inventors: Bhawan B. Patel, Mississauga (CA); Lorin Markarian, Etobicoke (CA); Melissa Despres, Verdun (CA)

(73) Assignee: Pratt & Whitney Canada Corp., Longueuil, QC (CA)

( * ) Notice: Subject to any disclaimer, the term of this patent is extended or adjusted under 35 U.S.C. 154(b) by 17 days.

(21) Appl. No.: 13/648,530

(22) Filed: Oct. 10, 2012

(65) Prior Publication Data

US 2013/0031909 A1 Feb. 7, 2013

Related U.S. Application Data

(62) Division of application No. 11/771,141, filed on Jun. 29, 2007, now Pat. No. 8,316,541.

(51) Int. Cl.

| | |
|---|---|
| ***F02C 1/00*** | (2006.01) |
| ***F02G 3/00*** | (2006.01) |
| ***F23R 3/60*** | (2006.01) |
| ***F23R 3/00*** | (2006.01) |

(52) U.S. Cl.

CPC . *F23R 3/60* (2013.01); *F23R 3/002* (2013.01); *F23R 2900/00018* (2013.01)

USPC ..... 60/752; 60/758; 60/754; 60/755; 60/756; 60/760; 60/737; 60/740; 60/742

(58) Field of Classification Search

USPC ..... 60/752–760, 737–748; 29/890.03, 29/890.039, 889.22

See application file for complete search history.

(56) References Cited

U.S. PATENT DOCUMENTS

| | | | |
|---|---|---|---|
| 1,751,448 | A | 3/1930 | Campbell, Jr. |
| 2,468,824 | A | 5/1949 | Hughey |
| 2,669,090 | A | 2/1954 | Jackson |
| 2,694,245 | A | 11/1954 | Rogers et al. |
| 2,775,566 | A | 12/1956 | Crowley |
| 2,939,199 | A | 6/1960 | Striven |
| 3,169,367 | A | 2/1965 | Hussey |
| 3,266,893 | A | 8/1966 | Duddy |
| 3,351,688 | A | 11/1967 | Kingery et al. |

(Continued)

FOREIGN PATENT DOCUMENTS

| | | |
|---|---|---|
| CA | 983215 | 2/1976 |
| CA | 990978 | 6/1976 |

(Continued)

OTHER PUBLICATIONS

Powder Metallurgy 2007 Facts—"A Growth Industry Vital to Many Products"; Metal Powder Industries Federation.

(Continued)

*Primary Examiner* — Craig Kim

(74) *Attorney, Agent, or Firm* — Norton Rose Fulbright Canada LLP

(57) ABSTRACT

A combustor dome heat shield and a louver are separately metal injection molded and then fused together to form a one-piece combustor heat shield.

5 Claims, 4 Drawing Sheets

(56) References Cited

U.S. PATENT DOCUMENTS

| | | | |
|---|---|---|---|
| 3,410,684 | A | 11/1968 | Print |
| 3,413,704 | A | 12/1968 | Addoms, Jr. et al. |
| 3,416,905 | A | 12/1968 | Waugh |
| 3,523,148 | A | 8/1970 | Boyer et al. |
| 3,595,025 | A | 7/1971 | Stöckel et al. |
| 3,608,309 | A | 9/1971 | Hill et al. |
| 3,615,054 | A | 10/1971 | La Botz |
| 3,698,849 | A | 10/1972 | Czerski |
| 3,704,499 | A | 12/1972 | Majkrzak et al. |
| 3,775,352 | A | 11/1973 | Leonard, Jr. |
| 3,782,989 | A | 1/1974 | Mansur |
| 3,888,663 | A | 6/1975 | Reichman |
| 3,889,349 | A | 6/1975 | Kaufman |
| 3,925,983 | A | 12/1975 | La Botz |
| 3,982,778 | A | 9/1976 | Spencer et al. |
| 4,011,291 | A | 3/1977 | Curry |
| 4,029,476 | A | 6/1977 | Knopp |
| 4,076,561 | A | 2/1978 | Lee et al. |
| 4,094,061 | A | 6/1978 | Gupta et al. |
| 4,176,433 | A | 12/1979 | Lee et al. |
| 4,197,118 | A | 4/1980 | Wiech, Jr. |
| 4,225,345 | A | 9/1980 | Adee et al. |
| 4,226,088 | A | 10/1980 | Tsukahara et al. |
| 4,236,923 | A | 12/1980 | Takahashi et al. |
| 4,246,757 | A | 1/1981 | Heberling |
| 4,274,875 | A | 6/1981 | Cadle et al. |
| 4,280,973 | A | 7/1981 | Moskowitz et al. |
| 4,283,360 | A | 8/1981 | Henmi et al. |
| 4,386,960 | A | 6/1983 | Iacovangelo et al. |
| 4,415,528 | A | 11/1983 | Wiech, Jr. |
| 4,419,413 | A | 12/1983 | Ebihara |
| 4,472,350 | A | 9/1984 | Urano |
| 4,475,344 | A | 10/1984 | Mumford et al. |
| 4,535,518 | A | 8/1985 | Jaqua |
| 4,590,769 | A | 5/1986 | Lohmann et al. |
| 4,615,735 | A | 10/1986 | Ping |
| 4,661,315 | A | 4/1987 | Wiech, Jr. |
| 4,702,073 | A | 10/1987 | Melconian |
| 4,708,838 | A | 11/1987 | Bandyopadhyay et al. |
| 4,734,237 | A | 3/1988 | Fanelli et al. |
| 4,765,950 | A | 8/1988 | Johnson |
| 4,780,437 | A | 10/1988 | Smith |
| 4,783,297 | A | 11/1988 | Ito et al. |
| 4,792,297 | A | 12/1988 | Wilson |
| 4,816,072 | A | 3/1989 | Harley et al. |
| 4,839,138 | A | 6/1989 | Filz |
| 4,874,030 | A | 10/1989 | Kuphal et al. |
| 4,881,431 | A | 11/1989 | Bieneck |
| 4,898,902 | A | 2/1990 | Nagai et al. |
| 4,913,739 | A | 4/1990 | Thümmler et al. |
| 5,021,208 | A | 6/1991 | Ludwig et al. |
| 5,059,387 | A | 10/1991 | Brasel |
| 5,059,388 | A | 10/1991 | Kihara et al. |
| 5,064,463 | A | 11/1991 | Ciomek |
| 5,094,810 | A | 3/1992 | Shira |
| 5,098,469 | A | 3/1992 | Rezhets |
| 5,129,231 | A | 7/1992 | Becker et al. |
| 5,135,712 | A | 8/1992 | Kijima et al. |
| 5,155,158 | A | 10/1992 | Kim |
| 5,165,226 | A | 11/1992 | Newton et al. |
| 5,215,946 | A | 6/1993 | Minh |
| 5,244,623 | A | 9/1993 | King |
| 5,250,244 | A | 10/1993 | Kimura et al. |
| 5,279,787 | A | 1/1994 | Oltrogge |
| 5,284,615 | A | 2/1994 | Ueda et al. |
| 5,286,767 | A | 2/1994 | Rohrbach et al. |
| 5,286,802 | A | 2/1994 | Uesugi et al. |
| 5,307,637 | A | 5/1994 | Stickles et al. |
| 5,310,520 | A | 5/1994 | Jha et al. |
| 5,312,582 | A | 5/1994 | Donado |
| 5,328,657 | A | 7/1994 | Kamel et al. |
| 5,332,537 | A | 7/1994 | Hens et al. |
| 5,338,617 | A | 8/1994 | Workinger et al. |
| 5,350,558 | A | 9/1994 | Kawato et al. |
| 5,366,679 | A | 11/1994 | Streicher |
| 5,368,795 | A | 11/1994 | Quadir |
| 5,380,179 | A | 1/1995 | Nishimura et al. |
| 5,397,531 | A | 3/1995 | Peiris et al. |
| 5,398,509 | A | 3/1995 | North et al. |
| 5,403,542 | A | 4/1995 | Weinl et al. |
| 5,409,650 | A | 4/1995 | Holme |
| 5,415,830 | A | 5/1995 | Zhang et al. |
| 5,421,853 | A | 6/1995 | Chen et al. |
| 5,423,899 | A | 6/1995 | Krall et al. |
| 5,429,792 | A | 7/1995 | Luk |
| 5,437,825 | A | 8/1995 | Jensen |
| 5,450,724 | A | 9/1995 | Kesseli et al. |
| 5,472,143 | A | 12/1995 | Bartels et al. |
| 5,476,632 | A | 12/1995 | Shivanath et al. |
| 5,482,671 | A | 1/1996 | Weber |
| 5,525,293 | A | 6/1996 | Kagawa et al. |
| 5,547,094 | A | 8/1996 | Bartels et al. |
| 5,554,338 | A | 9/1996 | Sugihara et al. |
| 5,574,957 | A | 11/1996 | Barnard et al. |
| 5,590,531 | A | 1/1997 | Desaulty et al. |
| 5,609,655 | A | 3/1997 | Kesseli et al. |
| 5,641,920 | A | 6/1997 | Hens et al. |
| 5,665,014 | A | 9/1997 | Sanford et al. |
| 5,669,825 | A | 9/1997 | Shira |
| 5,722,032 | A | 2/1998 | Gay |
| 5,730,929 | A | 3/1998 | Majumdar et al. |
| 5,848,350 | A | 12/1998 | Bulger |
| 5,864,955 | A | 2/1999 | Hirai |
| 5,950,063 | A | 9/1999 | Hens et al. |
| 5,956,955 | A | 9/1999 | Schmid |
| 5,977,230 | A | 11/1999 | Yang et al. |
| 5,989,493 | A | 11/1999 | La Salle et al. |
| 5,993,726 | A | 11/1999 | Huang et al. |
| 5,993,733 | A | 11/1999 | Kawai |
| 6,008,281 | A | 12/1999 | Yang et al. |
| 6,051,184 | A | 4/2000 | Kankawa |
| 6,060,017 | A | 5/2000 | Yang et al. |
| 6,071,325 | A | 6/2000 | Schmitt |
| 6,075,083 | A | 6/2000 | Peiris |
| 6,119,459 | A | 9/2000 | Gomez et al. |
| 6,159,265 | A | 12/2000 | Kinoshita et al. |
| 6,171,360 | B1 | 1/2001 | Suzuki et al. |
| 6,224,816 | B1 | 5/2001 | Hull et al. |
| 6,224,823 | B1 | 5/2001 | Lindenau et al. |
| 6,289,677 | B1 | 9/2001 | Prociw et al. |
| 6,319,437 | B1 | 11/2001 | Elsner et al. |
| 6,321,449 | B2 | 11/2001 | Zhao et al. |
| 6,322,746 | B1 | 11/2001 | LaSalle et al. |
| 6,350,407 | B1 | 2/2002 | Sakata et al. |
| 6,399,018 | B1 | 6/2002 | German et al. |
| 6,406,663 | B1 | 6/2002 | Goransson |
| 6,427,446 | B1 | 8/2002 | Kraft et al. |
| 6,428,595 | B1 | 8/2002 | Hayashi et al. |
| 6,468,468 | B1 | 10/2002 | Neubing et al. |
| 6,560,964 | B2 | 5/2003 | Steinhorsson et al. |
| 6,592,787 | B2 | 7/2003 | Pickrell et al. |
| 6,669,898 | B2 | 12/2003 | Gressel et al. |
| 6,730,263 | B2 | 5/2004 | Ernst et al. |
| 6,759,004 | B1 | 7/2004 | Dwivedi |
| 6,764,643 | B2 | 7/2004 | Sagawa et al. |
| 6,838,046 | B2 | 1/2005 | Lu et al. |
| 6,843,955 | B2 | 1/2005 | Ghosh et al. |
| 6,849,230 | B1 | 2/2005 | Feichtinger |
| 6,871,773 | B2 | 3/2005 | Fukunaga et al. |
| 6,939,509 | B2 | 9/2005 | Kochanek |
| 7,018,583 | B2 | 3/2006 | Berger et al. |
| 7,052,241 | B2 | 5/2006 | Decker |
| 7,827,800 | B2 * | 11/2010 | Stastny et al. ..... 60/752 |
| 8,316,541 | B2 * | 11/2012 | Patel et al. ..... 29/889.22 |
| 2002/0058136 | A1 | 5/2002 | Belhadjhamida |
| 2002/0109260 | A1 | 8/2002 | Boechat |
| 2003/0062660 | A1 | 4/2003 | Beard et al. |
| 2003/0213249 | A1 | 11/2003 | Pacheco-Tougas et al. |
| 2005/0036898 | A1 | 2/2005 | Sweetland |
| 2005/0254987 | A1 | 11/2005 | Azzi et al. |
| 2006/0127268 | A1 | 6/2006 | Yano et al. |
| 2007/0017817 | A1 | 1/2007 | Mueller et al. |
| 2007/0020135 | A1 | 1/2007 | Jackson et al. |
| 2007/0102572 | A1 * | 5/2007 | Bohdal ..... 244/62 |

(56) References Cited

U.S. PATENT DOCUMENTS

| | | | | |
|---|---|---|---|---|
| 2007/0104585 | A1 | 5/2007 | Ochiai et al. | |
| 2007/0137208 | A1 * | 6/2007 | Prociw et al. | 60/748 |
| 2012/0073303 | A1 * | 3/2012 | McCarren et al. | 60/752 |

FOREIGN PATENT DOCUMENTS

| | | | |
|---|---|---|---|
| CA | 996784 | | 9/1976 |
| CA | 2230994 | | 3/1997 |
| CA | 2204841 | | 11/1997 |
| CA | 2342328 | | 3/2000 |
| CA | 2347639 | | 4/2000 |
| CA | 2327759 | | 5/2001 |
| CA | 2388359 | | 5/2001 |
| CA | 2418265 | | 2/2002 |
| CA | 2381828 | | 10/2002 |
| EP | 0 511 428 | B1 | 9/1996 |
| EP | 1 046 449 | B8 | 10/2000 |
| JP | 03 039405 | A | 2/1991 |
| JP | 08 025151 | A | 1/1996 |
| JP | 08260005 | A | 10/1996 |
| WO | WO 97 38811 | A | 10/1997 |
| WO | WO 00/12248 | | 3/2000 |

OTHER PUBLICATIONS

Power Injection Moulding International (PIM International) "Flexibility Helps MIM Producer Meet the Demands of a Broad Client Base".

"An Introduction to Powder Metallurgy Materials and Design", Isabel J van Rooyen, Metals and Metals Processes, CSIR, Private bag X28, Auckland Park, 2006, South Africa.

NMC: "Enhanced Powder Metallurgy Processing of Superalloys for Aircraft Engine Components".

NATO:"Powder Injection Molding (PIM) for Low Cost Manufacturing of Intricate Parts to Net-Shape", Eric Baril et al., pp. 7-1 to 7-12.

NATO: "Metal Injection Moulding: A Near Net Shape Fabrication Method for the Manufacture of Turbine Engine Component", Benoit Julien et al., pp. 8-1 to 8-16.

Polymer Technologies, Inc.; "Plastic and Metal Injection Molding"; www.polymertechnologies.com.

Phillips Plastics Corporation; "MIM Metal Injection Molding Design Guide"; Nov. 12, 2004; www.phillipsmetals.com.

Egide; "Advanced Material Injection Moulding (AMIM)".

"The MIM Process"; www.epma.com.

"Powder Injection Molding"; www.powdermetinc.com/Technology.htm.

Cobef (Congresso Braileiro de Engenharia de Fabricacao); Paulo César G. Felix; Philip Frank Blazdel; Ricardo Emilio F.Q Nogueira; "*Production of Complex Parts by Low-Pressure Injection Molding of Granite Powders*".

J.E. Zorzi; C.A. Perottoni; J.A. H. da Jornada; "Wax-Based Binder for Low-Pressure Injection Molding and the Robust Proudction of Ceramic Parts".

Azom.com; "Powder Injection Moulding of Metals, Ceramics and Metal Matrix Composites"; www.azom.com.

Ceramic Industry; Ceratechno '06; Nov. 7-11, 2006; "Advancing Components with Low-Pressure Injection Molding"; www.ceramicindustry.com.

"Injection Molding Microstructures": www.ecs.umass.edu.

TEMS—a division of ND Industries, Inc.; "Low Pressure Injection Overmolding Ruggedizing Electrical/Electronic Components"; www.temsnd.com.

Peltsman; "Low Pressure Injection Molding"; www.pelcor.com.

Peltsman; "Automatic LPM Machine MIGL—37"; www.pelcor.com.

Axom.com; "Low Pressure Powder Injection Moulding of Metals, Ceramics and Metal Matrix Composites"; www.azom.com.

Goceram; "Medium Pressure Powder Injection Molding (MEDPIMOLD) Process"; www.goceram.com.

Goceram; "Medium Pressure Injection Moulding Machines"; www.goceram.com.

U.S. Appl. No. 60/139,354, filed Jun. 15, 1999, Lasalle, et al.

U.S. Appl. No. 11/551,021, filed Oct. 19, 2006, Stastny et al.

* cited by examiner

COMBUSTOR HEAT SHIELD WITH INTEGRATED LOUVER AND METHOD OF MANUFACTURING THE SAME

RELATED APPLICATIONS

This application is a divisional of U.S. patent application Ser. No. 11/771,141 filed on Jun. 29, 2007, the content of which is hereby incorporated by reference.

TECHNICAL FIELD

The present invention relates to gas turbine engine combustors and, more particularly, to combustor heat shields with film cooling louvers.

BACKGROUND OF THE ART

Heat shields are used to protect combustor shells from high temperatures in the combustion chamber. They are typically cast from high temperature resistant materials due to their proximity to the combustion flame. Casting operations are not well suited for complex-shaped parts and as such several constrains must be respected in the design of a combustor dome heat shield. For instance, a heat shield could not be cast with a film cooling louver due to the required tight tolerances between the louver and the heat shield. Also several secondary shaping operations must be performed on the cast heat shield to obtain the final product. Drilling and other secondary shaping operations into high temperature cast materials lead to high tooling cost as wear rates of drills and other shaping tools requires frequent cutting tool re-shaping or replacement.

There is thus a need for further improvements in the manufacture of combustor heat shields.

SUMMARY

In one aspect, there is provided a method for manufacturing a combustor heat shield, comprising the steps of: a) metal injection molding a green heat shield body; b) metal injection molding a green cooling louver; c) positioning said green cooling louver in partial abutting relationship with said green heat shield body so as to form an air cooling gap between a front face of the green heat shield body and the green cooling louver; and d) while said green heat shield body is in intimate contact with said green cooling louver, co-sintering said green heat shield body and said green cooling louver at a temperature sufficient to fuse them together into a one-piece component.

In a second aspect, there is provided a combustor dome heat shield and louver assembly, comprising a metal injection molded heat shield body, a metal injection molded louver, said metal injection molded heat shield and said metal injection molded louver having a pair of interfacing surfaces, and a seamless bond between said metal injection molded heat shield and said metal injection molded louver at said interfacing surfaces.

DESCRIPTION OF THE PREFERRED EMBODIMENTS

Figure 1:
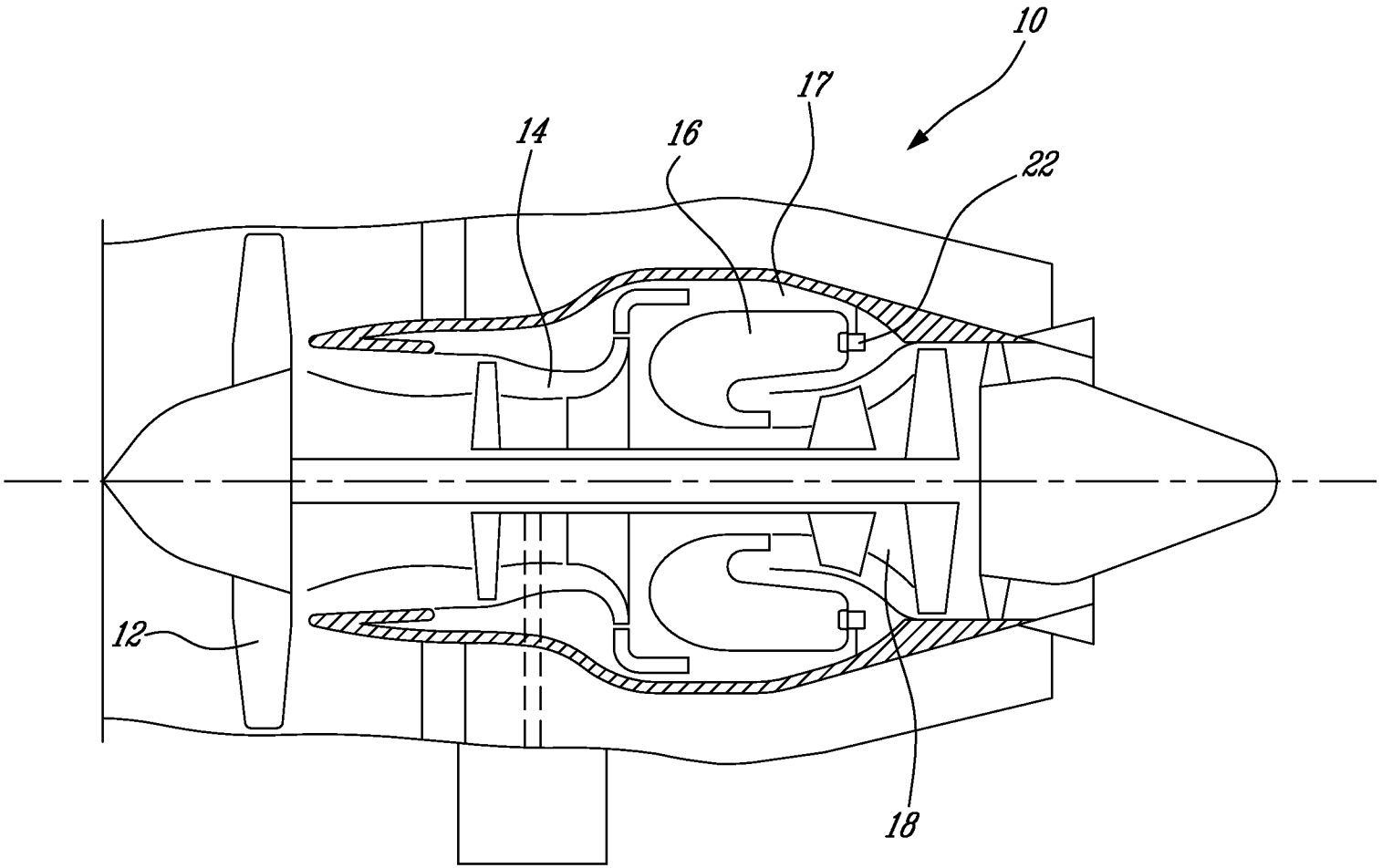
FIG. 1 is a schematic cross-sectional view of a gas turbine engine having an annular combustor.

FIG. 1 illustrates a gas turbine engine 10 generally comprising in serial flow communication a fan 12 (not provided with all types of engine) through which ambient air is propelled, a multistage compressor 14 for pressurizing the air, a combustor 16 in which the compressed air is mixed with fuel and ignited for generating an annular stream of hot combustion gases, and a turbine 18 for extracting energy from the combustion gases.

Figure 2:
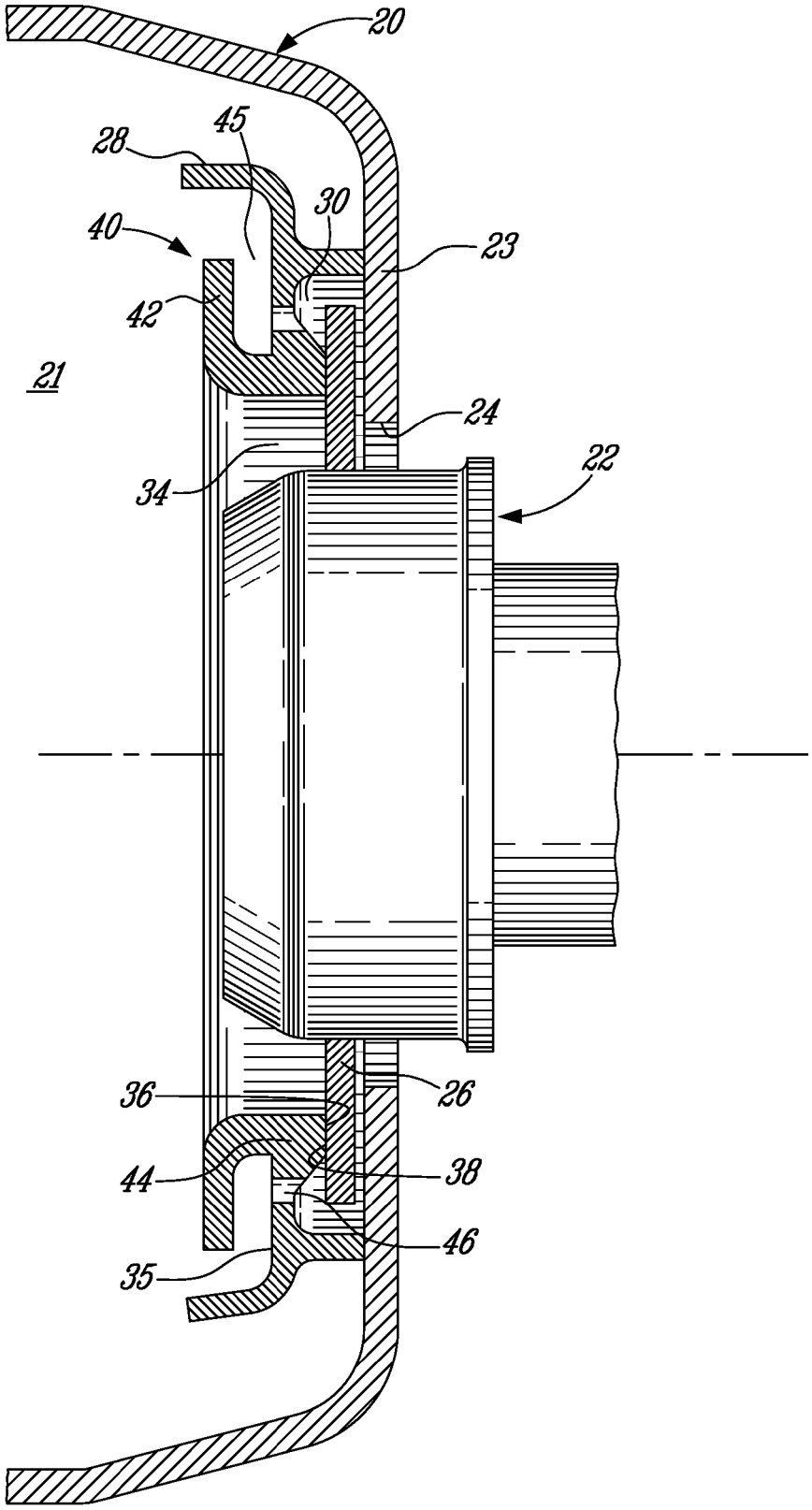
FIG. 2 is an enlarged cross-sectional view of a dome portion of the combustor, the combustor shell being protected against excessive heat by a heat shield having a louver for directing a film of cooling air on a hot surface of the heat shield.

The combustor 16 is housed in a plenum 17 supplied with compressed air from compressor 14. As shown in FIG. 2, the combustor 16 typically comprises a combustion shell 20 defining a combustion chamber 21 and a plurality of fuel nozzles (only one being shown at 22), which are typically equally spaced about the circumference of the combustion chamber 21 in order to permit a substantially uniform temperature distribution in the combustion chamber 21 to be maintained. The combustion shell 20 is typically made out from sheet metal. In use, fuel provided by a fuel manifold (not shown) is atomized by the fuel nozzles into the combustion chamber 21 for ignition therein, and the expanding gases caused by the fuel ignition drive the turbine 18 in a manner well known in the art.

Figure 3:
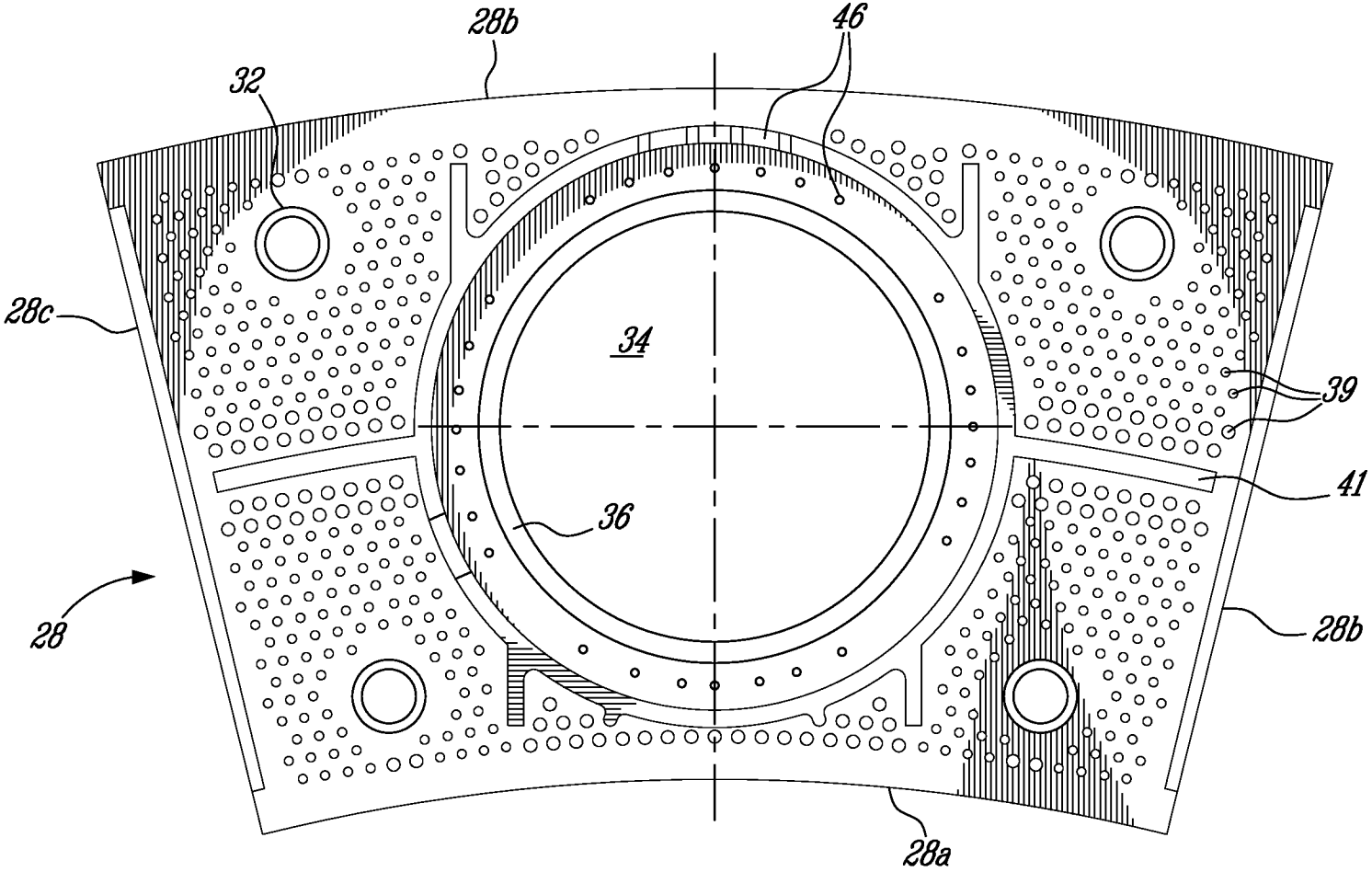
FIG. 3 is a back plan view of a heat shield segment.

As shown in FIG. 2, each fuel nozzle 22 is received in an opening 24 defined in a dome panel 23 of the combustor shell 20. A floating collar 26 is provided between the combustor shell 20 and the fuel nozzle 22. The floating collar 26 provides sealing between the combustor shell 20 and the fuel nozzle 22 while allowing relative movement therebetween. In the axial direction, the floating collar 26 is trapped between the dome panel 23 and a dome heat shield body 28. As shown in FIG. 3, the heat shield body 28 is provided in the form of an arcuate segment extending between a radially inner edge 28*a* and a radially outer edge 28*b* and two opposed lateral edges 28*c* and 28*d*. A plurality of heat shield bodies 28 are circumferentially disposed in an edge-to-edge relationship to form a continuous 360 degrees annular band on the dome panel 23 of the combustor shell 20. Each heat shield 28 is mounted to the dome panel 23 of the combustor shell 20 at a distance therefrom to define an air gap 30 (FIG. 2). In the illustrated example, the heat shield body 28 is attached to the combustor shell 20 by means of a number of threaded studs 32 (four the example illustrated in FIG. 3) extending at right angles from the back side of the heat shield body 28. The studs 32 protrude through corresponding holes in the dome panel 23 and are secured thereto by washers and self-locking nuts (not shown). Other fastening means could be used as well. A central circular opening 34 is defined in the heat shield body 28 for receiving the fuel nozzle 22. The heat shield body 28 is provided on the back side thereof with an annular flat sealing shoulder 36 which extends about the opening 34 for cooperating with a corresponding flat surface 38 on the front face of the floating collar 26. In operation, compressed air supplied from the engine compressor 14 into the plenum 17 in which the combustor 16 is mounted urges the flat surface 38 of the floating collar 26 against the flat surface 36 of the heat shield body 28, thereby providing a seal at the interface between the heat shield body 28 and the floating collar 26. Holes (not shown) are defined through the combustor shell 20 for directing cooling air into the air gap 30 to cool the back face of the heat shield 28. As shown in FIG. 3, heat exchange promoting structures such as pin fins 39, trip strips and divider walls 41 can be integrally formed on the back side of the heat shield 28 to increase cooling effectiveness.

As shown in FIG. 2, a film cooling louver 40 is provided on the front side of the heat shield body 28. The louver 40 has a radially extending annular deflector portion 42 bending smoothly into an axially rearwardly extending annular flange portion 44. The annular deflector portion 42 extends generally in parallel to and downstream of the front hot surface 35 of the heat shield body 28. The deflector portion 42 is axially spaced from the hot surface 35 of the heat shield 28 so as to define an air gap or plenum 45 therebetween. According to one embodiment, a gap of 0.040" is provided between the deflector portion 42 and the heat shield 28. The gap is calculated for optimum cooling of the heat shield front face 35. A series of circumferentially distributed cooling holes 46 are defined through the heat shield body 28 about the central opening 34 for allowing cooling air to flow from the air gap 30 into plenum 45 between the louver 40 and the heat shield body 28. The louver 40 re-directs the cooling air flowing through the cooling holes 46 along the hot surface 35. The air deflected by the louver 40 forms a cooling air film on the hot front surface 35 of the heat shield 28. This provides a simple and economical way to increase the heat shield cooling effectiveness.

Figure 4A:
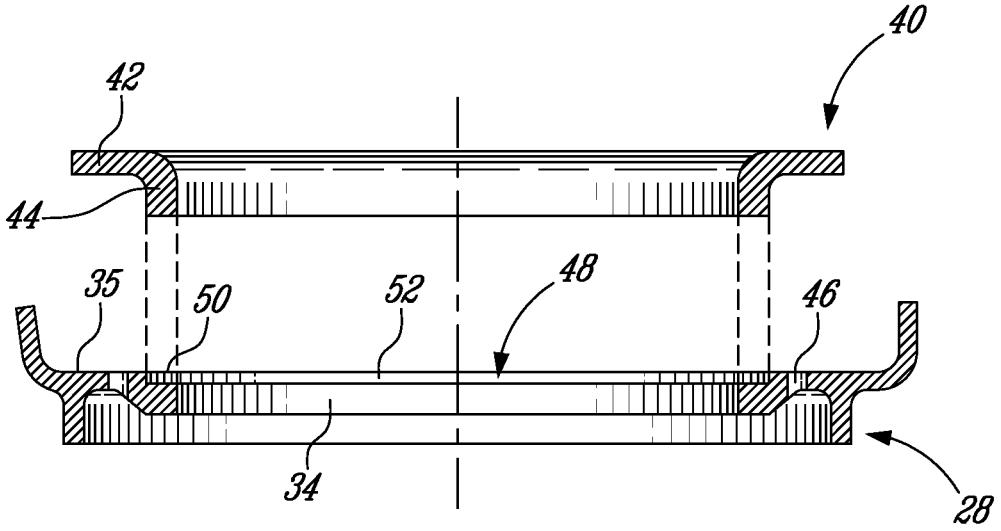
FIGS. 4*a* and 4*b* are cross-sectional views illustrating the process by which a metal injection molded louver is permanently fused to a metal injection molded heat shield body by means of a co-sintering process.
Figure 4B:
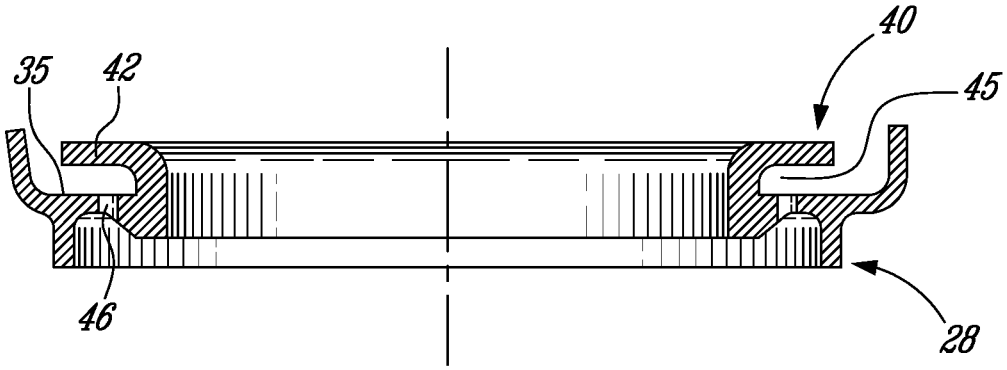

As can be appreciated from FIGS. 4*a* and 4*b*, the heat shield body 28 and the louver 40 are manufactured as separate parts by metal injection molding (MIM) and then the "green" heat shield body and the "green" louver are fused together by means of a co-sintering process. The heat shield body 28 and the louver 40 are made from a high temperature resistant powder injection molding composition. Such a composition can include powder metal alloys, such as IN625 Nickel alloy, or ceramic powders or mixtures thereof mixed with an appropriate binding agent. Other high temperature resistant compositions could be used as well. Other additives may be present in the composition to enhance the mechanical properties of the heat shield and louver (e.g. coupling and strength enhancing agents).

An interfacing annular recess 48 is molded in the front face 35 of the heat shield body 28 coaxially about the central opening 34 for matingly receiving the axially extending flange portion 44 of the louver 40 in intimate contact. The annular recess 48 is bonded by an axially extending shoulder 50 and a radially oriented annular shoulder 52 for interfacing in two normal planes with corresponding surfaces of the axially extending flange portion 44 of the louver 40. This provides for a strong bonding joint between the two parts. The engagement of the axially extending flange portion 44 in the recess 48 of the heat shield 28 also ensures proper relative positioning of the two metal injection molded parts. Accordingly, the louver 40 and the heat shield 28 can be accurately positioned with respect to each other without the need for other alignment structures or fixtures. However, it is understood that the louver 40 and the heat shield 28 could be provided with other suitable male and female aligning structures. The axial cooling gap 45 between the louver 40 and the heat shield 28 is determined by the length of the axially extending flange portion 44 of the louver 40 and the depth of the recess 48 of the heat shield body 28. The cooling holes 46 are molded in place through the heat shield 28. This eliminates the extra step of drilling holes through the heat shield body.

As shown in FIG. 4*a*, the MIM green louver 40 is placed on top of the MIM green heat shield body 28 while the same is being horizontally supported with its front surface 35 facing upwardly. This operation could also be accomplished in other orientations. The MIM green heat shield body 28 can be held by a fixture to prevent movement thereof while the MIM green louver 40 is being lowered into the interfacing recess 48 of the MIM green heat shield body 28. The MIM green louver 40 can be gently pressed downwardly by hand onto the MIM green heat shield body 28 to ensure intimate and uniform contact between flange portion 44 and shoulders 50 and 52. The applied force must be relatively small so as to not deform the green parts.

Once the MIM green louver 40 is appropriately positioned on the MIM green heat shield body 28, the resulting assembled green part is submitted to a debinding operation to remove the binder or the binding agent before the parts by permanently fused together by heat treatment. The assembled green part can be debound using various aqueous debinding solutions and heat treatments known in the art. It is noted that the assembly of the two separately molded parts could be done either before or after debinding. However, assembly before debinding is preferable to avoid any surface deformation at the mating faces of both parts during the debinding process. It also helps to bind the two parts together.

After the debinding operations, the louver 40 and the heat shield body 28 are co-sintered together to become a seamless unitary component as shown in FIG. 4*b*. The heat shield body 28 and the louver are preferably fused along their entire interface provided between shoulders 50 and 52 and the axially extending flange portion 44. The sintering operation can be done in inert gas environment or vacuum environment depending on the injection molding composition. Sintering temperatures are typically in the range of about 1100 to about 1200 Degrees Celsius depending on the base material composition of the powder. The co-sintering operation of the heat shield body 28 and the louver 40 takes about 4-8 hours followed by annealing (slow cooling). In some cases, it may be followed with hot isostatic pressing (HIP)—annealing under vacuum to minimize porosities. It is understood that the parameters of the co-sintering operation can vary depending on the composition of the MIM feedstock and on the configuration of the louver 40 and of the heat shield body 28.

It is noted that the density and size (i.e diameter and height) of the pin fins and the other heat exchange promoting structures on the back side of the heat shield have been selected to suit a MIM process and permit easy unmolding of the part. Some of the pin fins near the divider walls have also been integrated to the wall to avoid breakage during moulding.

The above description is meant to be exemplary only, and one skilled in the art will recognize that changes may be made to the embodiments described without department from the scope of the invention disclosed. For example, the invention may be provided in any suitable heat shield and louver configuration and in and is not limited to application in reverse flow annular combustors. Still other modifications which fall within the scope of the present invention will be apparent to those skilled in the art, in light of a review of this disclosure, and such modifications are intended to fall within the appended claims.

What is claimed is:

1. A combustor dome heat shield and louver assembly for a gas turbine engine, the combustor dome heat shield and louver assembly comprising:

a metal injection molded heat shield body, a metal injection molded louver, said metal injection molded heat shield body and said metal injection molded louver having a pair of interfacing surfaces, and a seamless bond between said metal injection molded heat shield body and said metal injection molded louver at said interfacing surfaces.

2. The combustor dome heat shield and louver assembly defined in claim 1, wherein said metal injection molded heat shield body and said metal injection molded louver are separately formed with mating male and female aligning portions, and wherein said pair of interfacing surfaces are provided on respective ones of said male and female aligning portions.

3. The combustor dome heat shield and louver assembly defined in claim 1, wherein said metal injection molded heat shield body has at least one opening for receiving a fuel nozzle tip, and wherein said metal injection molded louver has a flow diverting portion extending radially outwardly relative to said at least one opening at a distance from a front surface of the metal injection molded heat shield body, said flow diverting portion and said front surface defining an air gap.

4. The combustor dome heat shield and louver assembly defined in claim 3, wherein a series of holes are defined through the metal injection molded heat shield body, said series of holes being in flow communication with said air gap.

5. The combustor dome heat shield and louver assembly defined in claim 2, wherein said female aligning portion includes an annular recess formed in said metal injection molded heat shield body, and wherein said male aligning portion includes an annular flange projecting axially from a radially extending flow diverting flange of said metal injection molded louver.

* * * * *